US005867454A

United States Patent [19]

Takahashi et al.

[11] Patent Number: 5,867,454

[45] Date of Patent: Feb. 2, 1999

[54] AUTOMATIC WATCH

[75] Inventors: Masaaki Takahashi; Mitsuru Ishii, both of Chiba, Japan

[73] Assignee: Seiko Instruments Inc., Japan

[21] Appl. No.: 914,254

[22] Filed: Aug. 19, 1997

[30] Foreign Application Priority Data

Feb. 10, 1996 [JP] Japan ..... 8-261963

[51] Int. Cl.[6] ..... G04B 5/00; G04B 5/02

[52] U.S. Cl. ..... 368/148; 368/208

[58] Field of Search ..... 368/147–148, 368/151–152, 206–208

[56] References Cited

U.S. PATENT DOCUMENTS 3,901,019 8/1975 Kocher et la. ..... 368/208
3,901,021 8/1975 Tutiya ..... 368/208
4,174,607 11/1979 Wuthrich ..... 368/148
4,500,213 2/1985 Grimm ..... 368/208
4,809,250 2/1989 Meier ..... 368/208
5,119,348 6/1992 Mathys ..... 368/151

*Primary Examiner*—Vit W. Miska
*Attorney, Agent, or Firm*—Adams & Wilke

[57] ABSTRACT

An automatic watch, a complete barrel 30 is disposed on the side opposite from the dial of a main plate 22, i.e. on the front side, and has the center of rotation thereof within a first domain 310 or a fourth domain 340 of the main plate 22. An escape wheel & pinion 50, a pallet fork 60 and a balance 70 have their center of rotation within a third domain 330 or a fourth domain 340, respectively. A setting lever 120 and a yoke 130 are disposed on the front side of the main plate 22 and have their center of oscillation within the second domain 320, respectively. A yoke holder 140 holds a part of the setting lever 120 and a part of the yoke 130, respectively.

24 Claims, 7 Drawing Sheets

AUTOMATIC WATCH

BACKGROUND OF THE INVENTION

1. Field of the Invention

The present invention relates generally to an automatic watch in which a spring in a complete barrel is wound by an oscillating weight and more particularly to an automatic watch whose movement could have been miniaturized and thinned by disposing a front gear train mechanism and a change-over mechanism on the side opposite from a dial of a main plate.

2. Description of the Prior Art

A conventional automatic watch has had a main plate which constitutes a base of a movement and a change-over mechanism such as a setting lever and a yoke has been disposed on the dial side of the main plate. A calendar mechanism has been also disposed on the dial side of the main plate as necessary.

Here, the movement means a mechanical body including a mechanical structural and operational parts of a watch. An automatic watch is composed of the mechanical body and casing parts.

Further, a gear train mechanism, an escape speed governor and an automatic winder have been disposed on the side opposite from the dial of the main plate, i.e. on the front side.

A member for holding the setting lever has been also arranged so as to press, i.e. urge, only the part of the setting lever around the center of oscillation by its elastic force.

Further, no member for guiding incorporation of a clutch wheel has been provided.

Accordingly, the prior art automatic watch has had the following problems:

(1) Because the calendar mechanism is disposed on the dial side of the main plate, the change-over mechanism overlaps with the calendar mechanism, increasing the size of the movement or the thickness of the movement.

(2) There has been a possibility that either one of the setting lever or the yoke runs onto the other at a contact section of the setting lever and the yoke when a winding stem is pressed in.

(3) It has been hard to incorporate the clutch wheel.

Further, because the clutch wheel inclines when the winding stem is pulled out to decompose the automatic watch, the winding stem could not be readily incorporated again.

SUMMRY OF THE INVENTION

Accordingly, it is an object of the present invention to solve the aforementioned prior art problems by providing:

(1) a small and thin automatic watch;

(2) an automatic watch having a structure in which the setting lever and the yoke are hardly disconnected at the contact section thereof; and (3) an automatic watch which allows the clutch wheel to be incorporated readily.

In order to solve the aforementioned problems, an inventive automatic watch comprises a main plate; a center wheel & pinion which rotates centering almost on a center portion of the main plate as a center of rotation; a complete barrel having a spring; an escape speed governor mechanism; a winding stem and a clutch wheel; a change-over mechanism; a dial; and an oscillating weight for winding the spring via an automatic winding mechanism.

When there are defined, on the main plate, a main plate reference vertical axis which passes through the center of rotation of the center wheel & pinion and is almost parallel with the center axis of the winding stem and a main plate reference horizontal axis which passes through the center of rotation of the center wheel & pinion and is vertical to the main plate reference vertical axis, there are provided, on the main plate, a first domain positioned at one side of the main plate reference vertical axis and at the side closer to the winding stem from the main plate reference horizontal axis, a second domain positioned at the other side of the main plate reference vertical axis and at the side closer to the winding stem from the main plate reference horizontal axis, a third domain positioned on the other side of the main plate reference vertical axis where the second domain is located and at the side farther from the winding stem from the main plate reference horizontal axis, and a fourth domain positioned at one side of the main plate reference vertical axis where the first domain is located and at the side farther from the winding stem from the main plate reference horizontal axis.

The inventive automatic watch comprises the complete barrel disposed on the side opposite from the dial of the main plate and having the center of rotation within the first domain or the fourth domain; the escape wheel & pinion disposed on the side opposite from the dial of the main plate and having the center of rotation within the third domain or the fourth domain; the pallet fork disposed on the side opposite from the dial of the main plate and having the center of oscillation within the third domain or the fourth domain; the balance disposed on the side opposite from the dial of the main plate and having the center of rotation within the third domain or the fourth domain; the setting lever disposed on the side opposite from the dial of the main plate and having the center of oscillation within the second domain; the yoke disposed on the side opposite from the dial of the main plate and having the center of oscillation within the second domain; and a yoke holder for holding a part of the setting lever and a part of the yoke, respectively.

The inventive automatic watch further comprises a second wheel & pinion which is operative to indicate seconds; and a third wheel & pinion for transmitting the rotation of the center wheel & pinion to the second wheel & pinion; and preferably the center of rotation of the third wheel & pinion is located within the second domain or the third domain.

Further, in the inventive automatic watch, the complete barrel, the pallet fork, the escape wheel & pinion, the balance, the yoke and the setting lever are disposed in this order on the side opposite from the dial of the main plate clockwise or counter-clockwise around the center wheel & pinion on the basis of the main plate reference vertical axis.

Then, in the inventive automatic watch, the center of rotation of the pallet fork and the center of rotation of the escape wheel & pinion are disposed at the position closer to the center of rotation of the center wheel & pinion rather than the center of rotation of the balance; a part of the winding stem and a part of the balance are positioned so as to be almost opposite each other with respect to the main plate reference horizontal axis; and a part of the complete barrel and a part of the yoke are positioned so as to be almost opposite each other with respect to the main plate reference vertical axis.

Preferably, a part of the complete barrel and a part of the third wheel & pinion are disposed so as to be almost opposite each other with respect to the main plate reference vertical axis; and the center of rotation of the escape wheel & pinion and the center of rotation of the third wheel & pinion are positioned so as to be almost opposite each other with respect to the main plate reference horizontal axis.

Preferably, the yoke holder-comprises a first holding part for urging a part the setting lever around the center of oscillation to the main plate and a second holding part for urging a part of the setting lever between the part around the center of oscillation and a part of the setting lever contacting with the yoke to the main plate.

It is also preferable to have a clutch wheel incorporation guide member disposed adjacent to the clutch wheel on the side opposite from the dial.

DETAILED DESCRIPTION OF THE PREFERRED EMBODIMENTS

A mode for carrying out the invention will be explained below based on the drawings.

Figure 1:
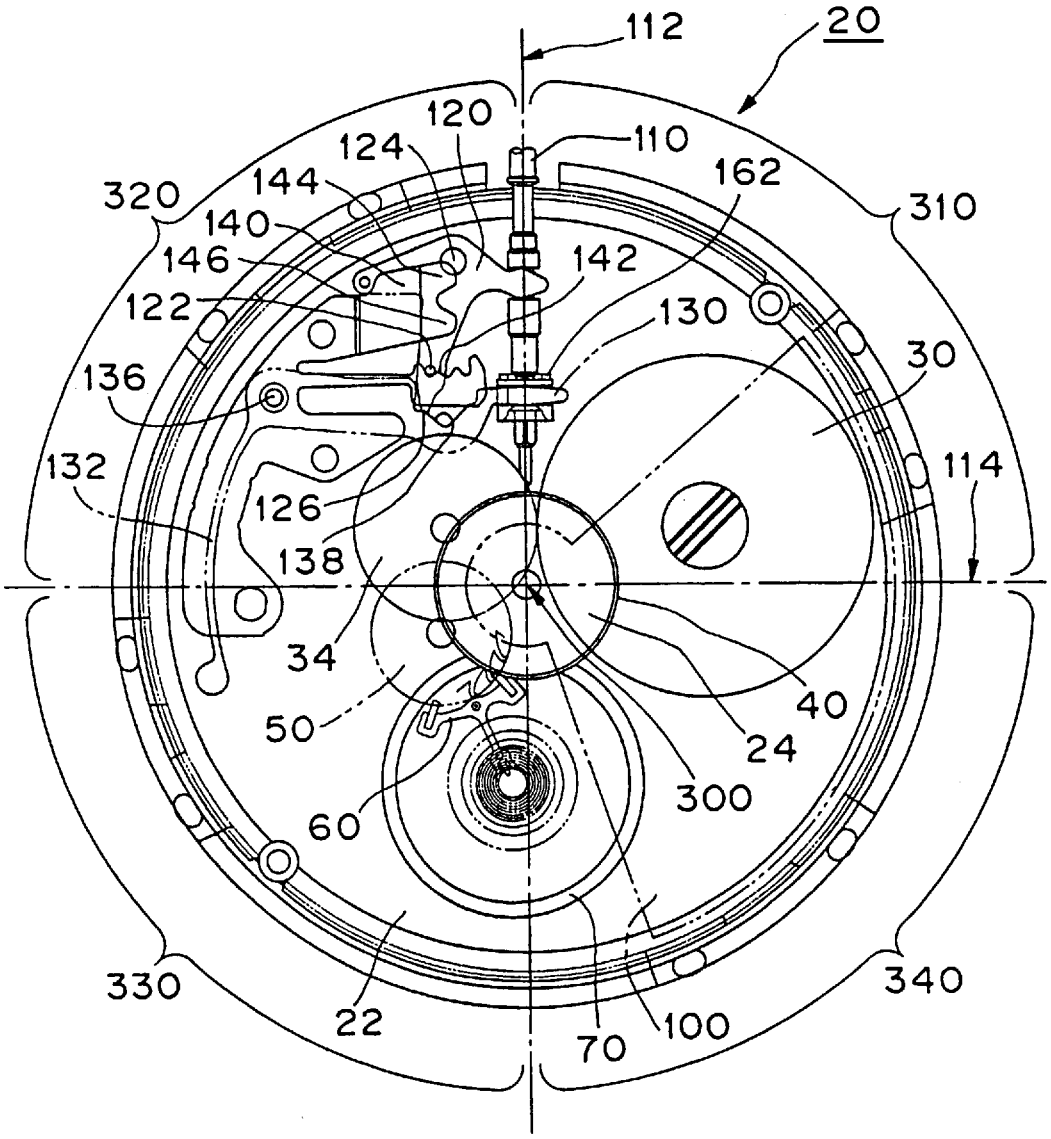
FIG. 1 is a plan view showing a schematic structure of a movement of an inventive automatic watch seen from the front side thereof in which an automatic winder, bridging member and others are not shown in order to clearly show the structure.
Figure 2:
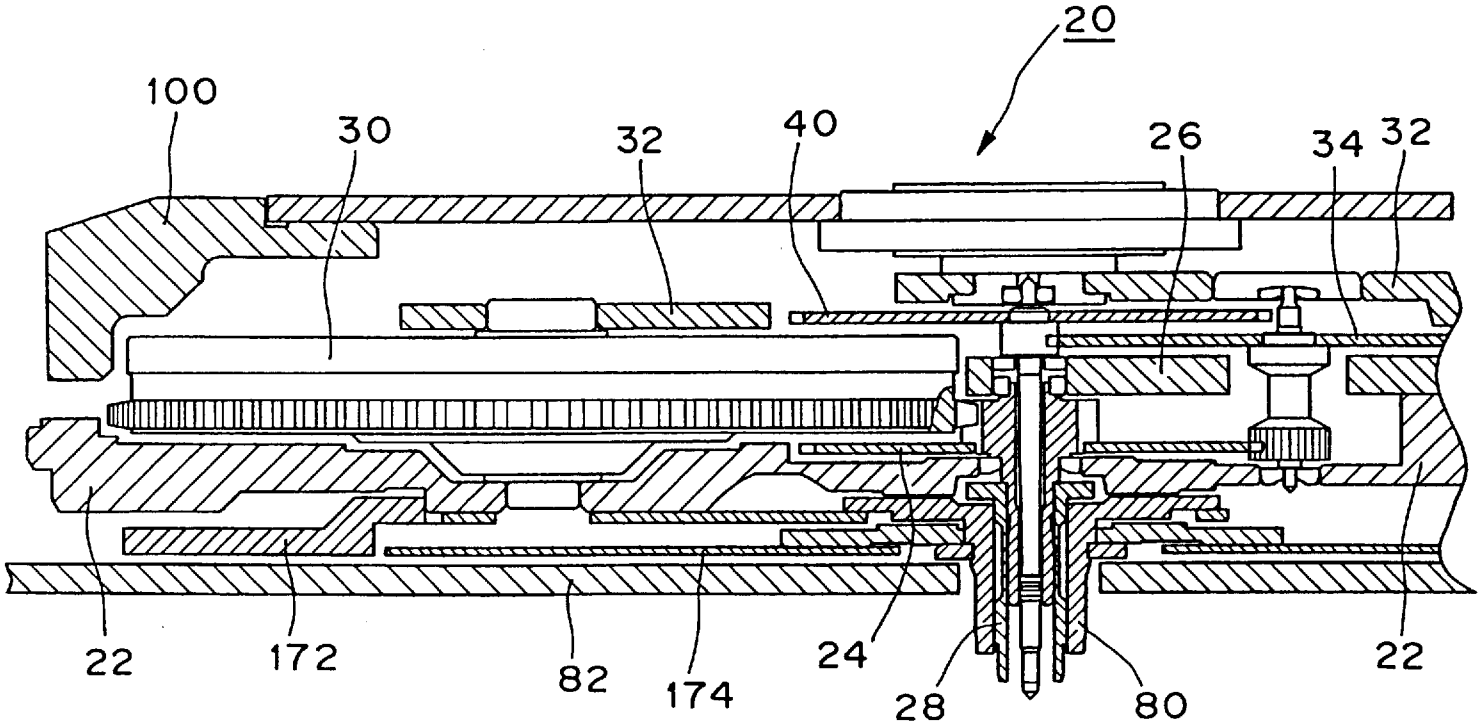
FIG. 2 is a section view showing a schematic structure of a barrel and front gear train part of the movement of the inventive automatic watch.

(1) Structure of Front Gear Train, Escape Speed Governor and Change-Over Mechanism In FIGS. 1 and 2, an inventive automatic watch is provided with a main plate 22 which constitutes a base of a movement 20. While the outside shape of the main plate 22 is almost circular in this mode, it may be another shape such as a rectangular, polygonal or elliptic shape.

According to the mode for carrying out the invention, a front gear train such as a complete barrel, a center wheel & pinion, a third wheel & pinion and a second wheel & pinion, an automatic winding mechanism such as an oscillating weight and a click lever, and a change-over mechanism such as a setting lever and a yoke are incorporated on the side opposite from the dial side, i.e. the front side, of the movement 20, respectively.

"The opposite side from the dial side of the movement" will be referred to as "the front side of the movement" in general because when a casing structure having a back lid (not shown) is used, the front side of the movement 20 is normally seen when the back lid is removed.

The inventive automatic watch may be also applied to a casing structure having no back lid as a matter of course, so that it is not intended to limit the present invention to the casing structure of the automatic watch having a back lid.

A center wheel & pinion 24 is incorporated rotatably nearly at the center of the main plate 22. The center wheel & pinion 24 is incorporated between the main plate 22 and a center wheel bridge 26. A cannon pinion 28 is incorporated on the dial side of the main plate 22 so as to be able to slip at the peripheral portion adjacent to an edge closer to a hand attaching part of the center wheel & pinion 24. The cannon pinion 28 rotates in a body with the center wheel & pinion 24.

A complete barrel 30 is incorporated rotatably between the main plate 22 and a barrel bridge 32. A gear of the complete barrel 30 engages with a second pinion of the center wheel & pinion 24. A third wheel & pinion 34 is incorporated rotatably between the main plate 22 and the barrel bridge 32. A second gear of the center wheel & pinion 24 engages with a third pinion. A second wheel & pinion 40 is incorporated rotatably between a center wheel bridge 26 and the barrel bridge 32. A third gear of the third wheel & pinion 34 engages with a fourth pinion of the second wheel & pinion 40.

Figure 3:
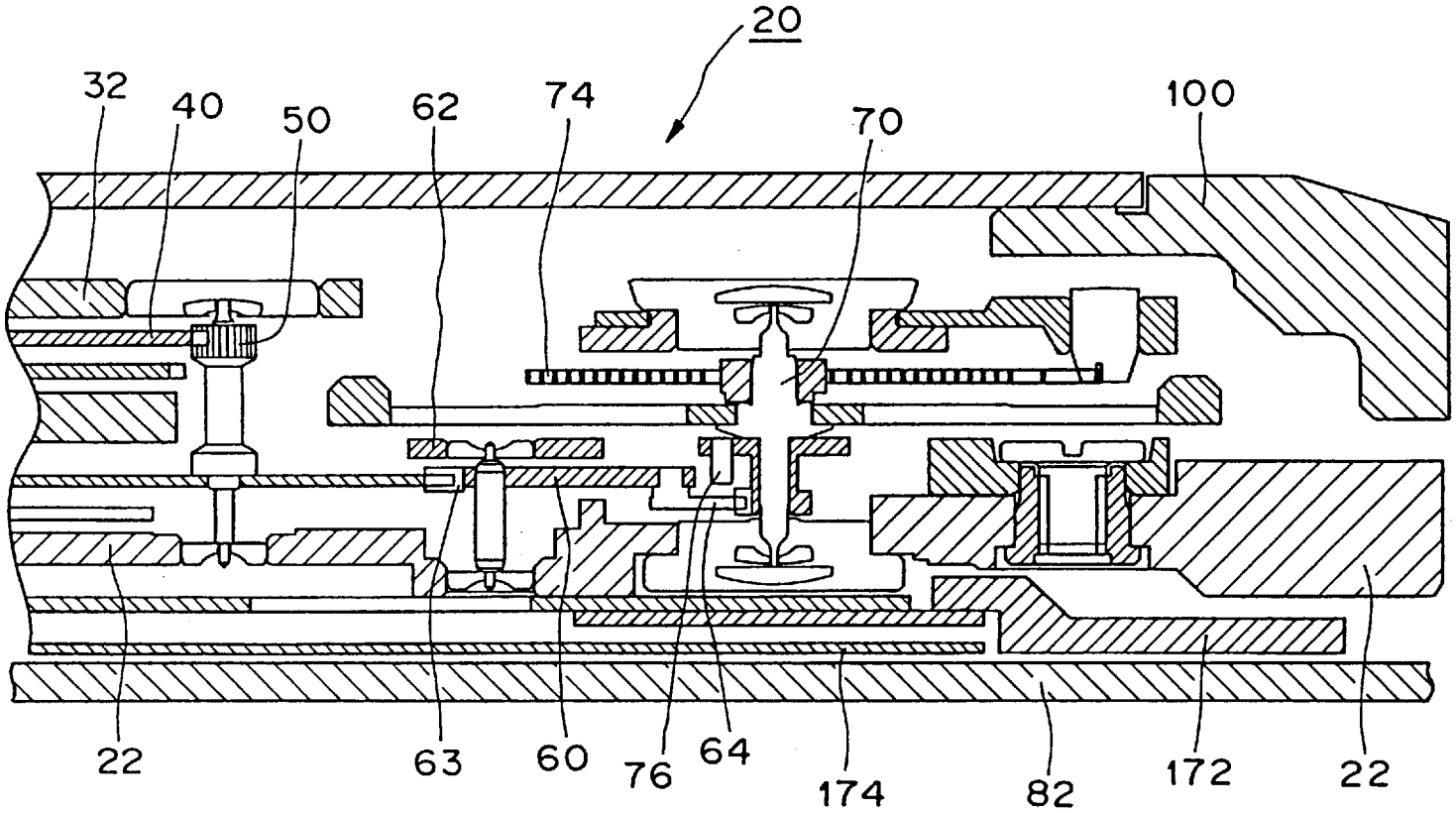
FIG. 3 is a section view showing a schematic structure of a balance, pallet fork and balance bridge part of the movement of the inventive automatic watch.

In FIGS. 1 through 3, an escape wheel & pinion 50 is rotatably incorporated between the main plate 22 and the barrel bridge 32. A fourth gear of the second wheel & pinion 40 engages with an escape pinion of the escape wheel & pinion 50. A pallet fork 60 is incorporated oscillably between the main plate 22 and a pallet bridge 62. The pallet fork 60 has two click stones 63 and bayonets 64. An escape wheel of the escape wheel & pinion 50 engages with the click stones 63. A balance 70 is incorporated rotatably between the main plate 22 and a balance bridge 72. The balance 70 has a hairspring 74 and a swing stone 76. The bayonet 64 engages with the swing stone 76.

Figure 5:
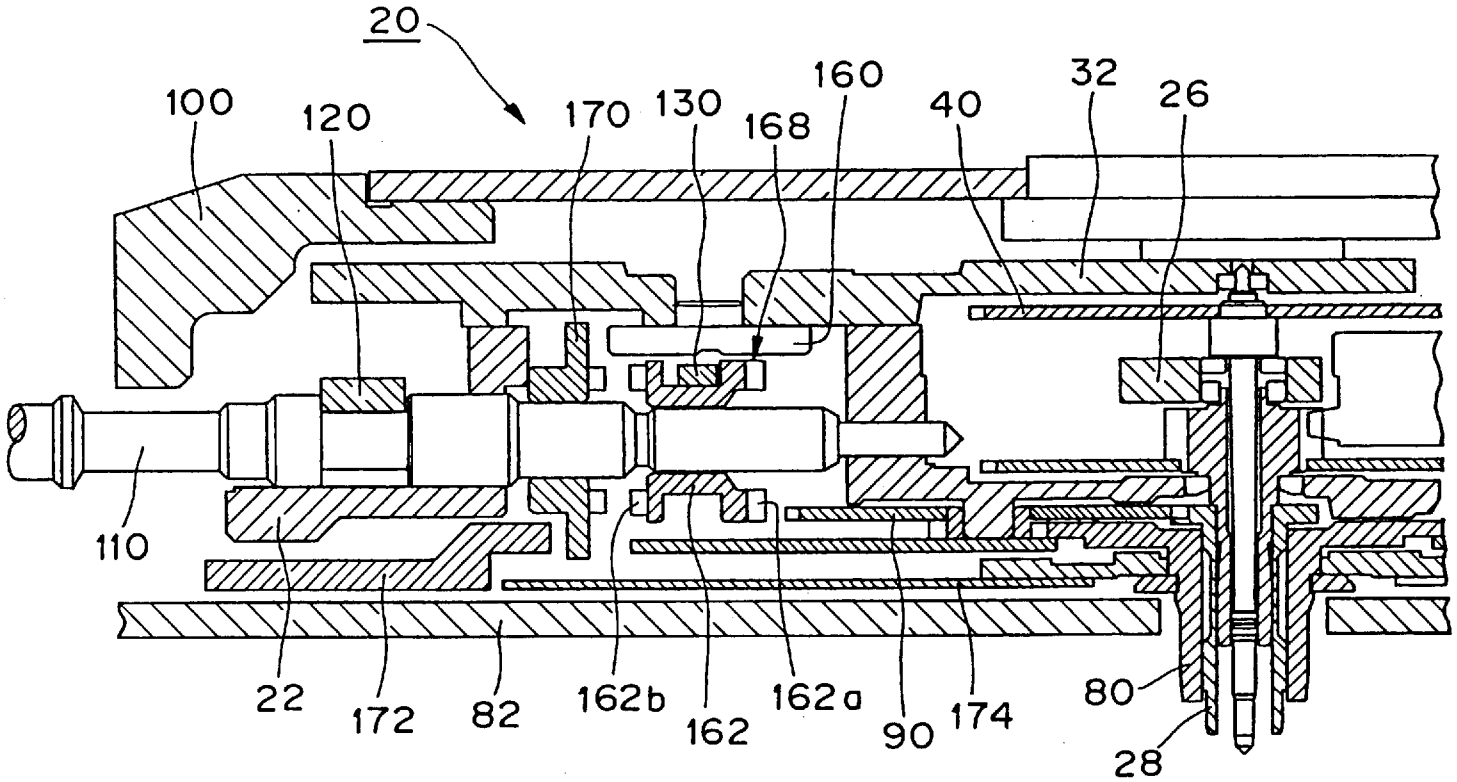
FIG. 5 is a section view showing a schematic structure of a winding stem part of the movement of the inventive automatic watch.
Figure 6:
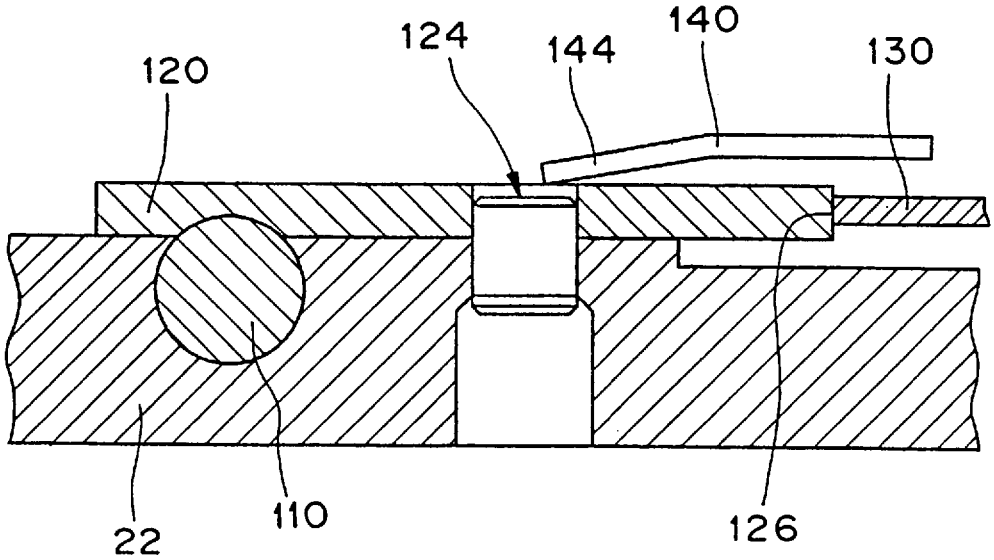
FIG. 6 is a section view showing a schematic structure of the setting lever and yoke part of the movement of the inventive automatic watch.

In FIGS. 2 and 5, a hour wheel 80 is incorporated rotatably in the main plate 22 on the side where a dial 82 is located. A minute wheel 90 is incorporated rotatably in the main plate 22 on the side where the dial 82 is located. A minute wheel gear of the minute wheel 90 engages with the cannon pinion 28. A minute pinion of the minute wheel 90 engages with the hour wheel 80.

In FIGS. 1 and 2, an oscillating weight 100 is incorporated rotatably to the barrel bridge 32. The oscillating weight 100 is incorporated to the barrel bridge 32 through an intermediary of a ball bearing (not shown). A first transmission wheel (not shown) is incorporated rotatably so as to engage with the pinion (not shown) of the oscillating weight 100. A click lever (not shown) is incorporated rotatably to an eccentric cam portion of the first transmission wheel.

A second transmission wheel (not shown) is incorporated rotatably to the click lever so as to engage with the click portion (not shown). A ratchet gear of the second transmission wheel (not shown) engages with the click portion of the click lever. They are arranged such that the first transmission wheel (not shown) rotates based on the rotation of the oscillating weight 100 and the second transmission wheel rotates only in a predetermined direction based on the operation of the click lever. The spring is wound based on the rotation of the second transmission wheel (not shown).

In FIGS. 1 through 7, there are defined, on the main plate 22, a main plate reference vertical axis 112 which passes through the center of rotation 300 of the center wheel & pinion 24 and is almost parallel with the center axis of the winding stem 110 and a main plate reference horizontal axis 114 which passes through the center of rotation 300 of the center wheel & pinion 24 and is vertical to the main plate reference vertical axis 112.

There is provided, on the main plate 22, a first domain 310 positioned at one side of the main plate reference vertical axis 112 and at the side closer to the winding stem 110 from the main plate reference horizontal axis 114. There is provided, on the main plate 22, a second domain 320 positioned at the other side of the main plate reference vertical axis 112 and at the side closer to the winding stem 110 from the main plate reference horizontal axis 114. There is provided, on the main plate 22, a third domain 330 positioned on the other side of the main plate reference vertical axis 112 where the second domain 320 is located and at the side farther from the winding stem 110 from the main plate reference horizontal axis 114. There is provided, on the main plate 22, a fourth domain 340 positioned at the above-mentioned one side of the main plate reference vertical axis 112 where the first domain 310 is located and at the side farther from the winding stem 110 from the main plate reference horizontal axis 114.

Figure 7:
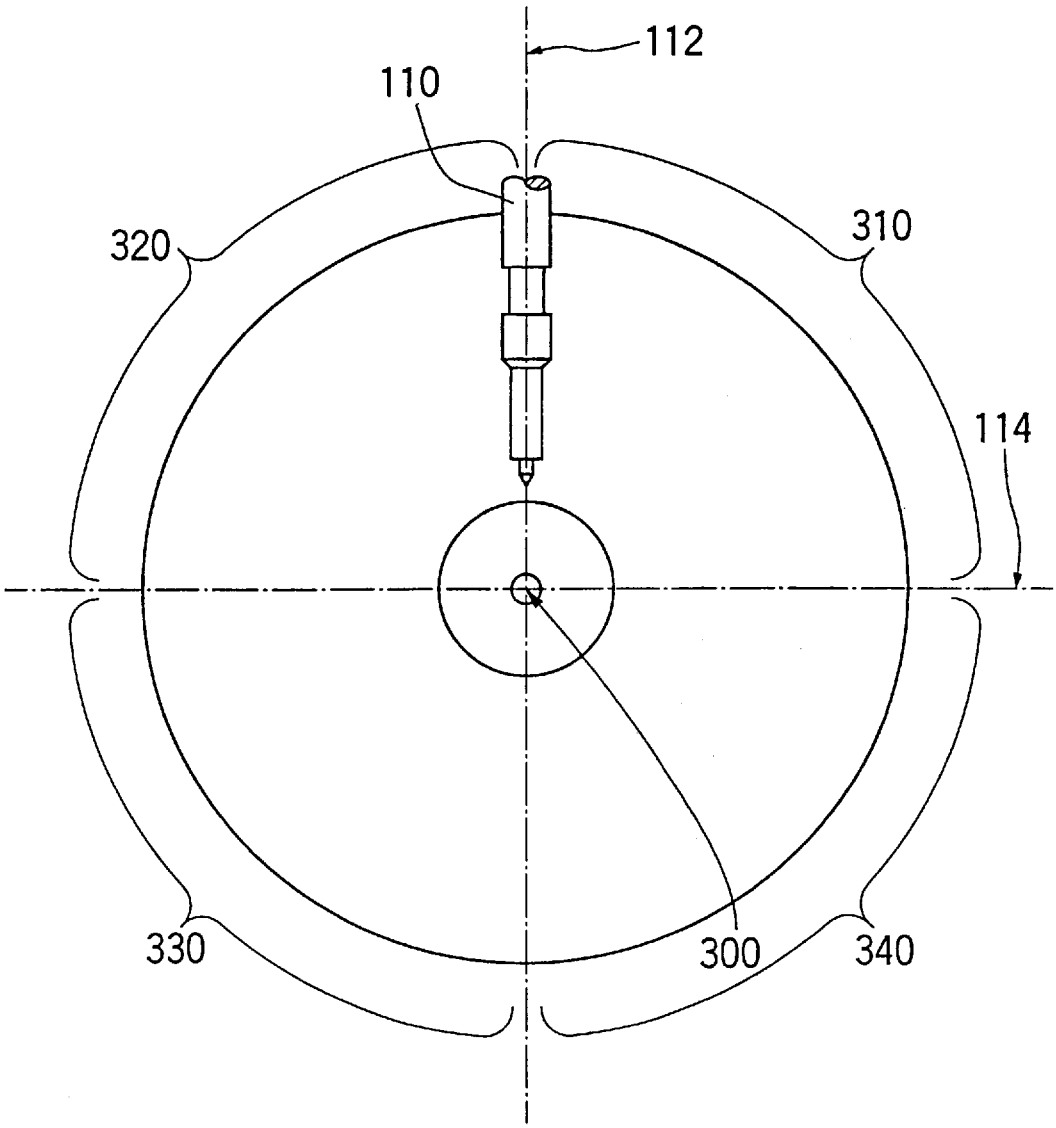
FIG. 7 is a schematic plan view showing sections of four domains of a main plate of the inventive automatic watch.

It is noted that although the first domain 310 and the fourth domain 340 are located on the right side of the main plate reference vertical axis 112 in FIG. 7, those domains may be defined so as to be located on the left side of the main plate reference vertical axis 112. Naturally, the second domain 320 and the third domain 330 should be defined so as to be located on the right side of the main plate reference vertical axis 112 in such a case.

In FIGS. 1 through 7, the center of rotation of the complete barrel 30 is located within the first domain 310. Such arrangement allows the spring having a large torque and is capable of operating for a long duration to be disposed effectively on the front side of the movement.

The center of rotation of the complete barrel 30 may be disposed also within the fourth domain 340.

The center of rotation of the escape wheel & pinion 50 is located within the third domain 330. The center of oscillation of the pallet fork 60 is located within the third domain 330. The center of rotation of the balance 70 is located within the third domain 330. Such arrangement allows the large complete barrel to be used. Such arrangement also allows the large balance having an excellent time accuracy and a large moment of inertia to be disposed effectively on the front side of the movement.

The center of rotation of the balance 70 may be disposed also within the fourth domain 340.

The center of oscillation of the pallet fork 60 and the center of rotation of the balance 70 may be disposed also within the fourth domain 340.

The center of rotation of the escape wheel & pinion 50, the center of oscillation of the pallet fork 60 and the center of rotation of the balance 70 may be disposed also within the fourth domain 340. Such arrangement allows the large third wheel & pinion to be disposed effectively on the front side of the movement.

The center of oscillation 124 of the setting lever 120 is located within the second domain 320. The center of oscillation of the yoke 130 is located within the second domain 320. The setting lever 120 and the yoke 130 are incorporated on the front side of the main plate 22. The yoke holder 140 presses parts of the setting lever 120 and the yoke 130, respectively, against the main plate 22.

The yoke holder 140 is made of an elastically deformable material and is preferable to be made of stainless steel for example. The yoke 130 is made of an elastically deformable material and is preferable to be made of stainless steel for example.

A spring portion 132 of the yoke 130 is located within the second domain 320 and the third domain 330. Such arrangement allows the long spring to be disposed effectively on the front side of the movement. The spring part 132 of the yoke 130 may be disposed only within the second domain 320. The shape of the yoke spring part 132 may be either straight, in bow or in U-shape.

An angle part 142 of the yoke holder 140 engages with a positioning pin 122 of the setting lever 120, thus positioning the setting lever 120 and setting a change-over weight of the winding stem 110. The angle part 142 of the yoke holder 140 is arranged so that the winding stem 110 may be pulled out to a first stage and a second stage in the inventive automatic watch. A guide valley section 138 of the yoke 130 is pressed against the side face of the edge of the setting lever 120 by force of the spring part 132 of the yoke 130.

The center of rotation of the second wheel & pinion 40 which operates to indicate seconds is the same with the center of rotation 300 of the center wheel & pinion 24. That is, the embodiment of the present invention is a three-center-hand watch. The center of rotation of the second wheel & pinion 40 may be disposed at the different position from the center of rotation 300 of the center wheel & pinion 24.

The third wheel & pinion 34 transmits the rotation of the center wheel & pinion 24 to the second wheel & pinion 40. The center of rotation of the third wheel & pinion 34 is located within the second domain 320. Such arrangement allows the large third wheel & pinion 34 to be disposed effectively on the front side of the movement.

The center of rotation of the third wheel & pinion 34 may be disposed within the third domain 330.

Here, a number of gear trains is not limited to those described above and one or more transmission wheels may be added.

It is noted that although it is preferable to dispose each part described above in the arrangement as shown in FIG. 1, it is possible to dispose them so as to be arranged mirror-symmetrically from the arrangement shown in FIG. 1 with respect to the main plate reference vertical axis 112.

For example, it is possible to arrange such that the center of rotation of the complete barrel 30 is located within the second domain 320, the center of rotation of the escape wheel & pinion 50 is located within the fourth domain 340, the center of oscillation of the pallet fork 60 is located within the fourth domain 340 and the center of rotation of the balance 70 is located within the fourth domain 340. Then, it is also possible to arrange such that the center of oscillation 124 of the setting lever 120 is located within the first domain 310 and the center of oscillation 136 of the yoke 130 is located within the first domain 310. Such arrangement also allows the small and thin automatic watch to be realized similarly to the arrangement shown in FIG. 1.

Further, in the inventive automatic watch, the complete barrel 30, the pallet fork 60, the escape wheel & pinion 50, the balance 70, the setting lever 120 and the yoke 130 are disposed in this order on the front side of the main plate 22 clockwise around the center wheel & pinion 24 on the basis of the main plate reference vertical axis 112 as shown in FIG. 1. Then, the center of rotation of the pallet fork 60 and the center of rotation of the escape wheel & pinion 50 are disposed at the position closer to the center of rotation 300 of the center wheel & pinion 24 rather than the center of rotation of the balance 70.

In the inventive automatic watch, the complete barrel 30, the pallet fork 60, the escape wheel & pinion 50, the balance 70, the setting lever 120 and the yoke 130 may be also disposed in this order on the front side of the main plate 22 counter-clockwise around the center wheel & pinion 24 on the basis of the main plate reference vertical axis 112 so that they are arranged mirror-symmetrically to the arrangement shown in FIG. 1. Then, the center of rotation of the pallet fork 60 and the center of rotation of the escape wheel & pinion 50 are disposed at the position closer to the center of rotation 300 of the center wheel & pinion 24 rather than the center of rotation of the balance 70 also in this arrangement.

A part of the winding stem 110 and a part of the balance 70 are positioned so as to be almost opposite each other with respect to the main plate reference horizontal axis 114. A part of the complete barrel 30 and a part of the yoke 130 are positioned so as to be almost opposite each other with respect to the main plate reference vertical axis 112. A part of the complete barrel 30 and a part of the third wheel 34 are positioned so as to be almost opposite each other with respect to the main plate reference vertical axis 112. The center of rotation of the escape wheel & pinion 50 and the center of rotation of the third wheel & pinion 34 are positioned so as to be almost opposite each other with respect to the main plate reference horizontal axis 114.

Next, an operation of the inventive automatic watch will be explained with reference to FIGS. 1 through 3.

The complete barrel 30 is rotated by force of the spring (not shown). The center wheel & pinion 24 is rotated as the complete barrel 30 rotates. The third wheel & pinion 34 is rotated as the center wheel & pinion 24 rotates. The second wheel & pinion 40 is rotated as the third wheel & pinion 34 rotates. The cannon pinion 28 is also rotated as the center wheel & pinion 24 rotates. The minute wheel 90 is rotated as the cannon pinion 28 rotates. The hour wheel 80 is rotated as the minute wheel 90 rotates. The rotational speed of each of the gear train is controlled by the operation of the balance 70, the pallet fork 60 and the escape wheel & pinion 50. As a result, the second wheel & pinion 40 rotates once in one minute. The cannon pinion 28 and the center wheel & pinion 24 rotate once in one hour. The hour wheel 80 rotates once in 12 hours.

"Second" is indicated by a second hand (not shown) attached to the second wheel & pinion 40. "Minute" is indicated by a minute hand (not shown) attached to the cannon pinion 28. "Hour" is indicated by a hour hand (not shown) attached to the hour wheel 80. That is, the second wheel & pinion 40, the cannon pinion 28, the center wheel & pinion 24 and the hour wheel 80 compose indicating wheels for indicating time information. The time is read by a scale or the like on the dial 82.

Next, winding of the spring by the automatic winder will be explained.

When one swings his/her arm while bearing the automatic watch, the click lever operates like the eccentric cam on the basis of the rotation of the oscillating weight 100 and winds the spring by the rotation of an automatic winding transmission wheel (not shown) or the like having a ratchet gear.

(2) Structure of Yoke Holder

Figure 4:
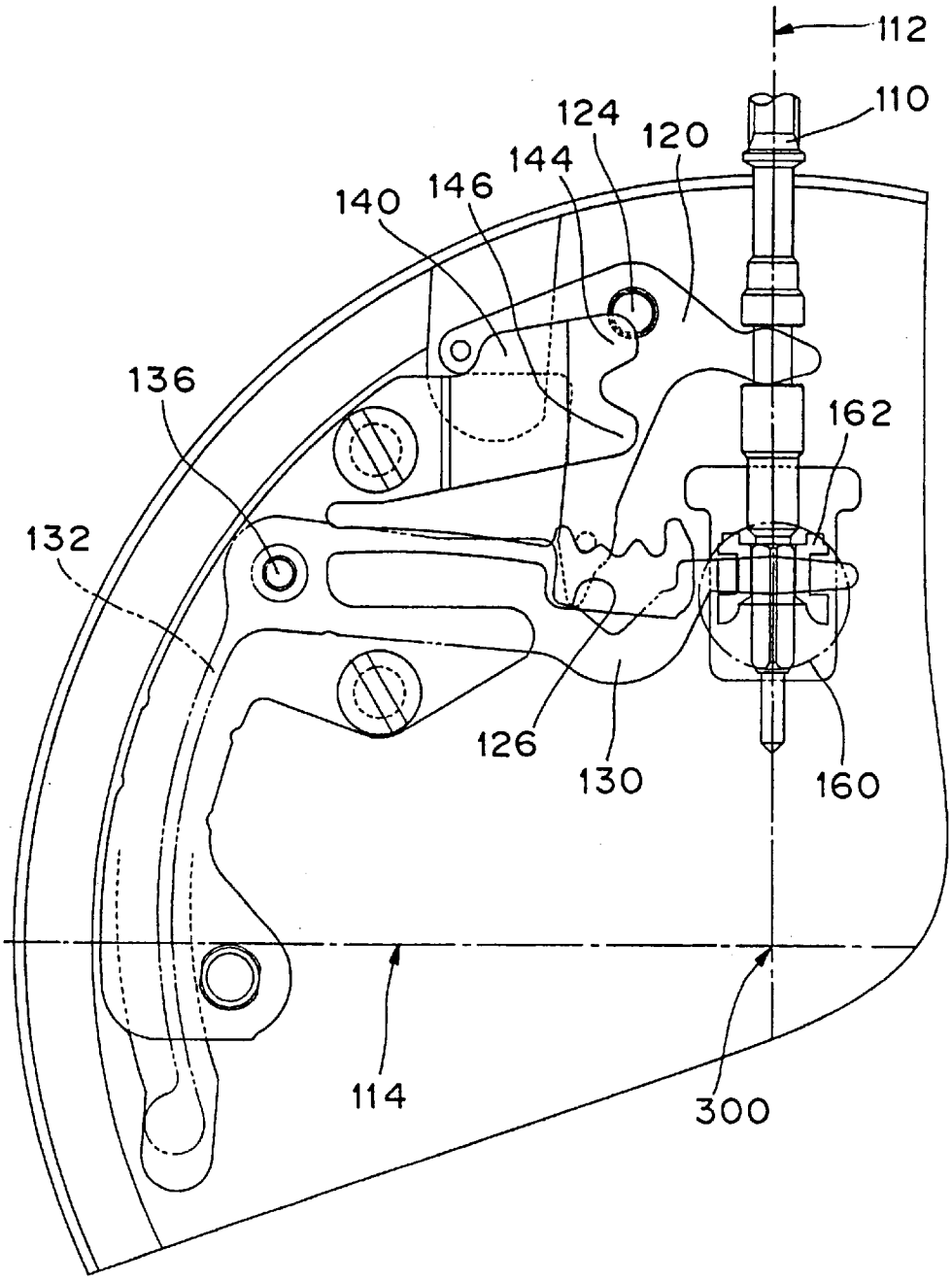
FIG. 4 is a section view showing a schematic structure of a setting lever and yoke part of the movement of the inventive automatic watch.

In FIG. 4, the yoke holder 140 is provided with a first holding part 144 for urging a part of the setting lever 120 around the center of oscillation 124 to the main plate. The yoke holder 140 is also provided with a second holding part 146 for urging a part of the setting lever 120 around the center of oscillation 124 and a part of the setting lever 120 between it and the contact section 126 with the yoke 130 to the main plate.

Force of the yoke holder 140 for holding the setting lever 120 is determined so as to have enough strength so that the engagement of the setting lever 120 with the yoke 130 will not come off when the winding stem 110 is pressed further from the zero stage. This force may be found by calculation or by experiment. Preferably, such holding force of the yoke holder 140 is about 150 gram.

Such holding structure by means of the yoke holder 140 keeps the possibility that the engagement of the setting lever 120 with the yoke 130 comes off to the minimum.

Next, an operation of the change-over mechanism of the invention will be explained with reference to FIGS. 4 and 5.

When one bears the automatic watch around arm, the winding stem 110 is normally on the zero stage. When one tries to correct the calendar, he/she pulls out the winding stem 110 to put on the first stage. At this time, the setting lever 120 is rotated. Then, the yoke 130 rotates by the spring force of the yoke and engages a gear B 162*b* of the clutch wheel 162 with a calendar corrector 170. When the winding stem 110 is rotated in this state, the clutch wheel 162 rotates, correcting a date indicator 172 or a day indicator 174 by the rotation of the calendar corrector 170.

Next, when one tries to correct time, he/she pulls out the winding stem 110 further to the second stage. At this time, the setting lever 120 rotates further. The yoke 130 rotates in the direction opposite from the above-mentioned rotation due to the spring force of the yoke and engages a gear A 162*a* of the clutch wheel 162 with the minute wheel 90. When the winding stem 110 is rotated in this state, the clutch wheel 162 rotates and the cannon pinion 28 and the hour wheel 80 rotate as the minute wheel 90 rotates, thus correcting the indication of time.

(3) Structure of Clutch Wheel Guide Member

In FIG. 4, a clutch wheel incorporation guide member 160 is fixed of the barrel bridge 32 on the side where the winding stem 110 is located. The clutch wheel incorporation guide member 160 may be made of a metal such as brass or of plastic.

The clutch wheel incorporation guide member 160 may be also formed in a body with the barrel bridge 32. It is preferable to form the clutch wheel incorporation guide section by way of cut work or plastic work when the barrel bridge 32 is made of a metal. It is preferable to form the clutch wheel incorporation guide section in a body with the barrel bridge 32 by injection molding or the like when the barrel bridge 32 is made of plastic.

The surface of the clutch wheel incorporation guide member 160 on the side where the dial 82 is located is disposed adjoining with the clutch wheel 162 so as to have a small gap 168 therebetween. The surface of the clutch wheel incorporation guide member 160 on the side where the dial 82 is located is formed into a dimension and shape which will not hamper the operation of the yoke 130. By arranging as such, the clutch wheel 162 rides on the surface of the clutch wheel incorporation guide member 160 when the winding stem 110 is pulled out while facing up the dial 82 for example to decompose the automatic watch. Accordingly, there is less possibility that the inclination of the clutch wheel 162 will make it difficult to assemble the automatic watch.

Because the automatic watch is arranged as described above according to the present invention, the following effects are brought about:

(1) The small and thin automatic watch may be realized;

(2) The small automatic watch may be realized because the gear train mechanism, the escape speed governor and the change-over mechanism are disposed without wasting any space;

(3) The clutch wheel may be readily assembled; and (4) The setting lever and the yoke are hardly disconnected at their contact section.

What is claimed is:

1. An automatic watch comprising:

a main plate defining a base of a movement;

a dial disposed on a first side of the main plate for displaying time information;

a center wheel and pinion mounted for rotation about a center of rotation thereof corresponding to a center of the main plate for driving a time-indicating member to indicate the time information;

a barrel having a spring and mounted for rotation to rotationally drive the center wheel and pinion;

an oscillating weight disposed on a second side of the main plate opposite to the first side thereof for winding the spring of the barrel member;

an escape speed governor control mechanism including an escape wheel and pinion, a pallet fork and a balance for controlling a rotational speed of the center wheel and pinion;

a winding stem and a clutch wheel connected to the winding stem for correcting time information;

a change-over mechanism including a setting lever connected to the winding stem and a yoke connected to the clutch wheel; and a yoke holder for urging a portion of the setting lever and a portion of the yoke against the main plate;

wherein the main plate has a reference vertical axis passing through the center of rotation of the center wheel and pinion and extending generally parallel to a center axis of the winding stem, a reference horizontal axis passing through the center of rotation of the center wheel and pinion and extending generally vertical to the reference vertical axis a first domain positioned at a first side of the reference vertical axis and extending in a direction toward the winding stem from the reference horizontal axis, a second domain positioned at a second side of the reference vertical axis opposite the first side and extending in a direction toward the winding stem from the reference horizontal axis, a third domain positioned at the second side of the reference vertical axis and extending in a direction away from the winding stem from the reference horizontal axis, and a fourth domain positioned at the first side of the reference vertical axis and extending in a direction away from the winding stem from the reference horizontal axis; the barrel member being disposed on the second side of the main plate and having a center of rotation disposed within the first domain or the fourth domain; the escape wheel and pinion being disposed on the second side of the main plate and having a center of rotation disposed within the third domain or the fourth domain; the pallet fork being disposed on the second side of the main plate and having a center of oscillation disposed within the third domain or the fourth domain (340); the balance being disposed on the second side of the main plate and having a center of rotation disposed within the third domain or the fourth domain; the setting lever being disposed on the second side of the main plate and having a center of oscillation disposed within the second domain; and the yoke being disposed on the second side the main plate and having a center of oscillation disposed within the second domain.

2. An automatic watch according to claim 1, further comprising a second wheel and pinion for indicating seconds; and a third wheel and pinion for transmitting the rotation of the center wheel and pinion to the second wheel and pinion; wherein a center of rotation of the third wheel and pinion is disposed within the second domain or the third domain.

3. An automatic watch according to claim 1; wherein the yoke holder has a first holding part for urging a part of the setting lever around the center of oscillation thereof against the main plate, and a second holding part for urging a part of the setting lever between the part around the center of oscillation thereof and a contact section of the setting lever contacting with the yoke against the main plate.

4. An automatic watch according to claim 2; wherein the yoke holder has a first holding part for urging a part of the setting lever around the center of oscillation thereof against the main plate, and a second holding part for urging a part of the setting lever between the part around the center of oscillation thereof and a contact section of the setting lever contacting with the yoke against the main plate.

5. An automatic watch according to claim 1; further comprising a guide member for guiding the clutch member and disposed on the second side of the dial.

6. An automatic watch according to claim 2; further comprising a guide member for guiding the clutch member and disposed on the second side of the dial.

7. An automatic watch comprising:

a main plate defining a base of a movement;

a dial disposed on a first side of the main plate for displaying time information;

a center wheel and pinion mounted for rotation about a center of rotation thereof corresponding to a center of the main plate for driving a time indicating member to indicate the time information;

a barrel member having a spring and mounted for rotation to rotationally drive the center wheel and pinion;

an oscillating weight disposed on a second side of the main plate opposite to the first side thereof for winding the spring of the barrel member;

an escape speed governor control mechanism including an escape wheel and pinion, a pallet fork and a balance for controlling a rotational speed of the center wheel and pinion;

a winding stem and a clutch wheel connected to the winding stem for correcting the time information;

a change-over mechanism including a setting lever connected to the winding stem and a yoke connected to the clutch wheel; and a yoke holder for urging a portion of the setting lever and a portion of the yoke against the main plate;

an oscillating weight (100) disposed on the side opposite from said dial of said main plate (22) for winding the spring in said complete barrel (30) via an automatic winding mechanism; wherein the main plate has a reference vertical axis passing through the center of rotation of the center wheel and pinion and extending generally parallel to a center axis of the winding stem a reference horizontal axis passing through the center of rotation of the center wheel and pinion and extending generally vertical to the reference vertical axis; the barrel member, the pallet fork, the escape wheel and pinion, the balance, the yoke and the setting lever being disposed in this order on the second side of the main plate clockwise or counter-clockwise around the center the reference vertical axis; a center of rotation of the pallet fork and a center of rotation of the escape wheel and pinion being disposed at a position closer to the center of rotation of the center wheel and pinion than to a center of rotation of the balance; a part of the winding stem and a part of the balance being positioned so as to be almost opposite each other with respect to the reference horizontal axis; and a part of the barrel member and a part of the yoke being disposed so as to be almost opposite each other with respect to the reference vertical axis.

8. An automatic watch according to claim 7; further comprising a second wheel and pinion for indicating seconds; and a third wheel and pinion for transmitting the rotation of the center wheel and pinion to the second wheel and pinion; wherein a part of the barrel member and a part of the third wheel and pinion are disposed so as to be almost opposite each other with respect to the reference vertical axis; and wherein the center of rotation of the escape wheel and pinion and a center of the third wheel and pinion are positioned so as to be almost opposite each other with respect to the reference horizontal axis.

9. An automatic watch according to claim 8, wherein the yoke holder has a first holding part for urging a part of the setting lever around the center of oscillation thereof against the main plate, and a second holding part for urging a part of the setting lever between the part around the center of oscillation thereof and a contact section of the setting lever contacting with the yoke against the main plate.

10. An automatic watch according to claim 9; further comprising a clutch wheel incorporation guide member disposed adjacent to the clutch wheel on the second side of the dial.

11. An automatic watch according to claim 7; wherein the yoke holder has a first holding part for urging a part of the setting lever around the center of oscillation thereof against the main plate, and a second holding part for urging a part of the setting lever between the part around the center of oscillation thereof and a contact section of the setting lever contacting with the yoke against the main plate.

12. An automatic watch according to claim 7; further comprising a guide member for guiding the clutch member and disposed on the second side of the dial.

13. An automatic watch according to claim 8; further comprising a guide member for guiding the clutch member and disposed on the second side of the dial.

14. An automatic watch comprising:

a main plate having a vertical axis, a horizontal axis disposed generally perpendicular to the vertical axis, a first domain disposed at a first side of the vertical axis and at a first side of the horizontal axis, a second domain disposed at a second side of the vertical axis opposite the first side thereof and at the first side of the horizontal axis, a third domain disposed at the second side of the vertical axis and at a second side of the horizontal axis opposite the first side thereof, and a fourth domain disposed at the first side of the vertical axis and at the second side of the horizontal axis;

a central gear rotatable about a center of rotation corresponding to a center of the main plate for driving a time-indicating member to indicate time information, the vertical axis and the horizontal axis of the main plate passing through the center of rotation of the central gear;

a rotational member for rotationally driving the central gear as a function of time and having a center of rotation disposed in the first domain or the fourth domain;

a control mechanism for controlling a rotational speed of the central gear; and a correcting mechanism for correcting the time information indicated by the time-indicating member.

15. An automatic watch according to claim 14; wherein the control mechanism comprises an escape wheel and pinion having a center of rotation disposed within the third domain or the fourth domain, a pallet fork having a center of oscillation disposed within the third domain or the fourth domain, and a balance having a center of rotation disposed within the third domain or the fourth domain.

16. An automatic watch according to claim 15; further comprising a dial disposed on a first side of the main plate for displaying the time information indicated by the time-indicating member.

17. An automatic watch according to claim 16; wherein the escape wheel and pinion, the pallet fork and the balance are disposed on a second side of the main plate opposite the first side thereof.

18. An automatic watch according to claim 16; wherein the rotational member has a spring; and further comprising an oscillating weight disposed on a second side of the main plate opposite the first side thereof for winding the spring of the rotational member.

19. An automatic watch according to claim 14; wherein the correcting mechanism comprises a winding stem and a clutch wheel connected to the winding stem.

20. An automatic watch according to claim 19; further comprising a setting lever connected to the winding stem and having a center of oscillation disposed within the second domain, a yoke connected to the clutch wheel and having a center of oscillation disposed within the second domain, and a yoke holder for urging a portion of the setting lever and a portion of the yoke against the main plate.

21. An automatic watch according to claim 20; further comprising a dial disposed on a first side of the main plate for displaying the time information indicated by the time-indicating member.

22. An automatic watch according to claim 21; wherein the setting lever and the yoke are disposed on a second side of the main plate opposite the first side thereof.

23. An automatic watch according to claim 19; wherein the vertical axis of the main plate extends generally parallel to a central axis of the winding stem.

24. An automatic watch according to claim 19; wherein the first and second domains extend in directions towards the winding stem from the horizontal axis of the main plate; and wherein the third and fourth domains extend in directions away from the winding stem from the horizontal axis of the main plate.

* * * * *

UNITED STATES PATENT AND TRADEMARK OFFICE

CERTIFICATE OF CORRECTION

PATENT NO. : 5,867,454

DATED : February 2, 1999

INVENTOR(S) : TAKAHASHI et al.

It is certified that error appears in the above-indentified patent and that said Letters Patent is hereby corrected as shown below:

COLUMN 6

Line 46, --the balance 70,-- should be inserted after "30,".
Line 47, "the balance 70, the setting lever 120 and the yoke 130" should read --the yoke 130 and the setting lever 120--.
Line 57, "the balance" should be deleted and --the balance 70,-- should be inserted before "the pallet fork 60,".
Line 58, "70, the setting lever 120 and the yoke 130" should read --the yoke 130 and the setting lever 120--.

IN CLAIM 7, COLUMN 10

Line 50, --the balance,-- should be inserted after "member,".
Line 51, "the balance," should be deleted.

Signed and Sealed this

Twenty-first Day of March, 2000

*Attest:*

*Attesting Officer*

Q. TODD DICKINSON

*Commissioner of Patents and Trademarks*